US005971388A

United States Patent [19]

Hattori et al.

[11] Patent Number: 5,971,388

[45] Date of Patent: Oct. 26, 1999

[54] AUTOMATIC ORIGINAL DOCUMENT FEEDING DEVICE WHICH HAS DIFFERENT PROCEDURES FOR CORRECTING PAPER JAMS DEPENDING ON WHERE THE JAM OCCURS

[75] Inventors: Hitoshi Hattori, Urawa; Takashi Taruki, Hiratsuka; Hiroshi Kubo, Yokohama, all of Japan

[73] Assignee: Ricoh Company, Ltd., Tokyo, Japan

[21] Appl. No.: 08/607,354

[22] Filed: Feb. 26, 1996

[30] Foreign Application Priority Data

Feb. 24, 1995 [JP] Japan ..... 7-036340

[51] Int. Cl.[6] ..... B65H 5/00

[52] U.S. Cl. ..... 271/10.03; 271/117; 271/258.01; 271/273; 271/157

[58] Field of Search ..... 271/10.03, 34, 271/117, 126, 127, 157, 258.01, 152, 154–156, 273, 274

[56] References Cited

U.S. PATENT DOCUMENTS

| | | | |
|---|---|---|---|
| 4,763,891 | 8/1988 | Kodama | 271/157 |
| 4,925,177 | 5/1990 | Nakamura et al. | 271/258.01 X |
| 5,465,949 | 11/1995 | Yamada et al. | 271/126 X |

FOREIGN PATENT DOCUMENTS

| | | |
|---|---|---|
| 63-139822 | 6/1988 | Japan . |
| 1-220646 | 9/1989 | Japan . |
| 5-188689 | 7/1993 | Japan . |
| 7-5732 | 1/1995 | Japan . |

*Primary Examiner*—Boris Milef

*Attorney, Agent, or Firm*—Oblon, Spivak, McClelland, Maier, & Neustadt, P.C.

[57] ABSTRACT

An automatic original document feeding device which can shorten a length of time required for refeeding sheets of the original document after a jamming of a sheet of the original document is cleared. When a trouble signal is received indicating that a sheet of the original document remains within a feed path due to an improper feeding or a jamming before the sheet is completely scanned, a side cover is opened and at the same time a driving mechanism is actuated for automatically lowering the sheets of the original document from a feeding position. If the jamming occurs at a later position in the paper path after the image has been completely scanned, the side cover does not have to be opened, the driving mechanism is not lowered, and the sheets of the original document remain in their feeding position.

20 Claims, 6 Drawing Sheets

AUTOMATIC ORIGINAL DOCUMENT FEEDING DEVICE WHICH HAS DIFFERENT PROCEDURES FOR CORRECTING PAPER JAMS DEPENDING ON WHERE THE JAM OCCURS

BACKGROUND OF THE INVENTION

1. Field of the Invention

The present invention is directed to an automatic feeding device which can be used in an apparatus such as an image forming device. The invention is more particularly related to an automatic document feeder and its controller which alters a clamped state of a stack of original pages to be scanned, depending on where a paper jam of the automatic document feeder occurs.

2. Discussion of the Background

Image forming devices, such as copying machines, are known. Such image forming devices have various elements such as sensors and timers which can detect when a paper being fed through the image forming device has jammed. Typically, an operator of the copying machine is then informed of the jam and the operator can then take actions to alleviate the jam situation.

However, the drawback with such conventional devices is that after the jam condition is alleviated, there is often a delay until the device is prepared to continue the copying operation. That is, in such conventional devices, a situation may be presented that certain elements of an automatic document feeder are automatically positioned after a paper jam in order to assure that an operator has the ability to clear the jam. However, it may not be necessary to move all elements of the document feeder for every type of jam. Accordingly, an operator may needlessly wait for the elements of the document feeder to return to their original position after a jam has been cleared, even if it was not necessary to move the elements after the jam occurred.

SUMMARY OF THE INVENTION

Accordingly, one object of the present invention is to provide a novel automatic feeding device which can overcome the drawbacks of conventional devices.

Another object of the present invention is to provide a novel original document feeding device which only repositions elements after a paper jam occurs from a normal paper feeding position when required. A further object of the invention is to maintain elements in a paper feeding position, where appropriate, so that when the jam is cleared, there is no unnecessary delay in waiting for the elements to be repositioned to the proper feeding position.

The present invention achieves these and other objects utilizing an automatic original feeding device which feeds a plurality of sheets of an original document. According to the present invention, the sheets of an original document are placed in a tray. The sheets are then clamped or pressurized against a feed roller or belt. These sheets are then fed by separating the sheets of the original document sheet by sheet and conveying the sheets through a conveying path towards an image reading position.

During the feeding process, the movement through the automatic document feeder of original sheets is monitored. The monitoring process determines both when a jam occurs and the position at which the jam occurs. In the present invention, if it is determined that the paper jam has occurred in a feeding path which is between the tray of originals and a scanning position, the sheets of the original document which remain in a feeding position are unclamped when the front cover of the automatic document feeder is opened. The paper jam can then be cleared and the sheet which caused the jam which was never scanned can then be placed back with the sheets of the original document to be copied. Once the sheets of the document are properly returned to the tray, the stack of sheets is reclamped or placed in pressured contact against the feed roller or belt.

However, if the paper jam occurs after the conveying path, i.e., after the fed sheet has already been scanned, then the sheets of the original document which remain in a housing are not removed from their feeding or clamped position. After the paper jam is cleared, the feeding of the sheets can immediately continue without any unnecessary delay due to the need to reclamp or push the stack of sheets against the feed roller or belt.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1A:
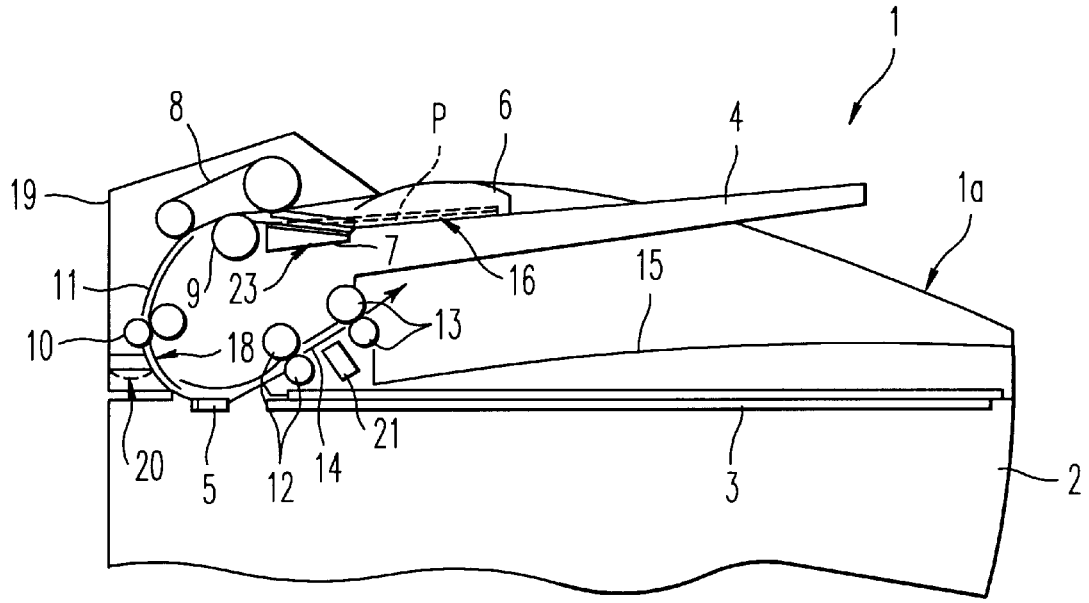
FIG. 1A shows a cross-sectional view from the front of an automatic original document feeding device according to the present invention in which the side cover is closed.

Referring now to the drawings, wherein like reference numerals designate identical or corresponding parts throughout the several views, and more particularly to FIG. 1A thereof, there is shown a cross-sectional view of one embodiment of the original document feeding device 1 according to the present invention. This device 1 is provided in an openable and closable manner relative to a contact glass 3 provided on an upper plane of a copying machine 2. The original document feeding device is constructed to separate a plurality of sheets of an original document P, which have been placed on an original setting stand or tray 4, sheet by sheet and automatically feed the sheets to a slit glass 5 through which the sheets are read or scanned. While the automatic original feeding device 1 is described with respect to the copying machine 2, the feeding device 1 is equally applicable to facsimile machines, scanners, or any device which utilizes a document feeder.

A pair of side fences 6 are provided on the original setting stand 4 (only the side fence 6 at the front end is shown in FIG. 1A), and the side fences 6 secure a positioning of the original document P in its width direction. Also, a push-up plate 7 is provided on the left side of the original setting stand 4 (the front end side of the sheets of the original document P). The push-up plate 7 is constructed to push up front ends of the sheets of the original document P so that the sheets of the original document P contact a lower end of a feeding belt 8. When in this position, referred to as a predetermined feeding position, the sheets are clamped between the feeding belt 8 and the push-up plate 7, resulting in pressured contact or clamping between the feeding belt 8 and the push-up plate 7 so that the top sheet of the document contacts the belt 8 and the bottom sheet of the document contacts the push-up plate 7. Alternatively, the feeding belt 8 can be replaced by a feeding roller. In this embodiment, the original setting stand 4 and the push-up plate 7 constitute a receiving/piling unit for piling and housing a plurality of sheets of the original document P.

The feeding belt 8 is constructed to feed the sheets of the original document P which have been pushed up by the push-up plate 7, and the sheets of the original document P which have been fed by this feeding belt 8 are separated by a separating roller 9 in such a manner that only a top sheet of the original document P at the uppermost position is separated and fed.

This separated sheet of the original document P is guided by a pair of conveying rollers 10 through a feeding path 11 to the slit glass 5 which constitutes a reading or scanning position of the sheets of the original document P. The separated sheet is then exposed to light on this slit glass 5 by an exposure device which is not shown in the figures in order to read or scan the sheet. The sheet of the original document P which has been read or scanned is then conveyed through an ejecting path 14 by a pair of conveying rollers 12 and a pair of discharging rollers 13, and is then discharged onto an original document discharging tray 15.

An original document detecting sensor 16 is provided at the original setting stand 4. This sensor 16 detects an original document P on the original setting stand 4 and outputs a signal to a controller 17 (illustrated in FIG. 3) based on this detection. The document detecting sensor 16 can also be constructed to detect a size of the sheets of the original document P. In order to detect a size of the original sheets, a plurality of sensors corresponding to different sizes can be utilized. Depending on which sensors are covered by the stack of originals, the size of the originals can be determined. The sensors to detect the size can be arranged either along the length or the width of the tray. Further, a register sensor 18 monitors the feeding path 11 to detect forward and rear ends of the sheets of the original document P and to output a signal to the controller 17 based on this detection. The controller 17 is constructed to output in a conventional manner a signal to the copying machine 2 based on the signal from the register sensor 18, and the copying machine 2 controls an exposure device and the copying operation based on such. The signal is utilized to synchronize the automatic feeding operation with the scanning performed by the copying machine 2.

Figure 1B:
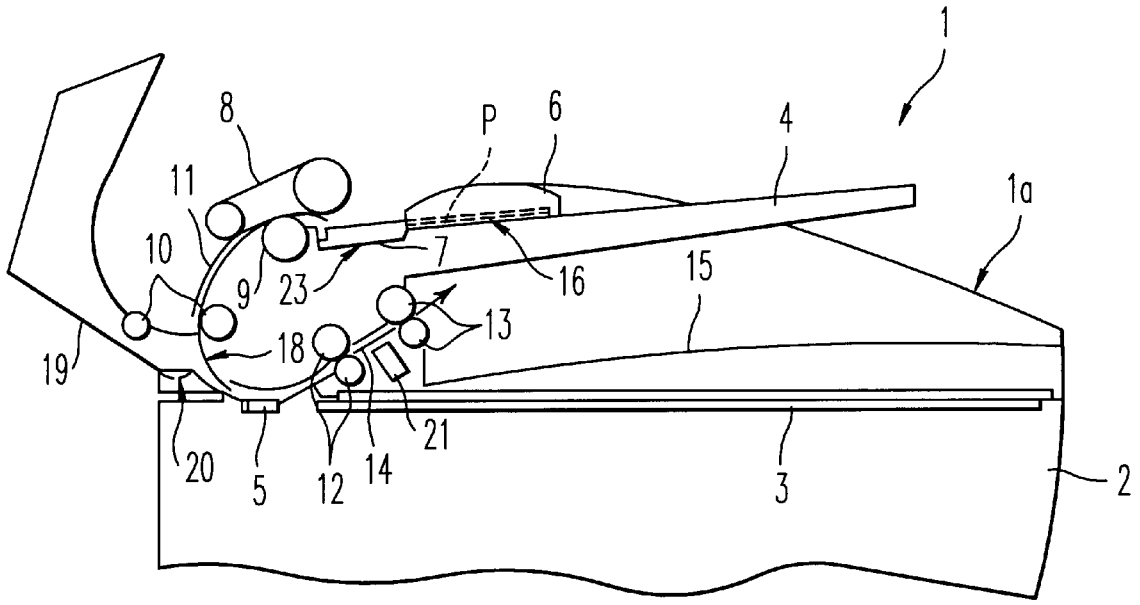
FIG. 1B shows the automatic document feeding device of FIG. 1A with the side cover opened.

A side cover 19 is provided at a side of a body 1*a* of the original feeding device 1. By opening the side cover 19, as illustrated in FIG. 1B, it is possible to gain access to and clear a paper jam which has occurred in the feeding path 11. The side cover can be constructed to form at least part of the feeding path 11. As illustrated in FIG. 1B, when the side cover 19 is opened, one of the pair of conveying rollers 10 moves so that the conveying roller 10 separate from each other. There is a microswitch 20 which detects whether the side cover 19 is opened or closed. This switch 20 is turned on and off depending on whether the side cover 19 is opened or closed and outputs a signal to the controller 17 based on the detected position of the side cover 19. Also, a discharging sensor 21 is provided on the ejecting path 14, and this sensor 21 detects forward and rear ends of sheets of the original document P and outputs a signal to the controller 17 based on this detection.

Figure 3:
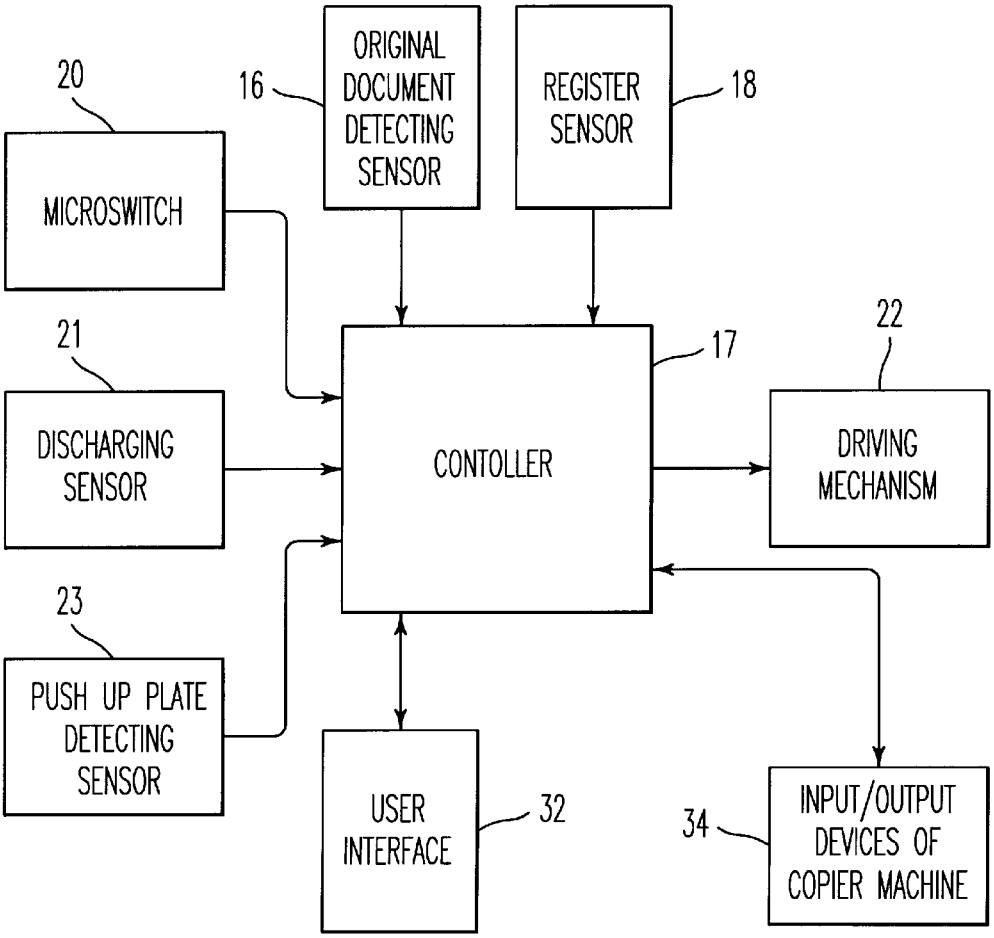
FIG. 3 is a block diagram of the control system of the original document feeding device of the present invention.

The push-up plate 7 is moved up and down by a driving mechanism 22, as illustrated in block diagram form in FIG. 3. The driving mechanism 22 may include a motor such as a stepper motor, a reduction gear to slow down the driving force of the motor, and an actuator to convert the movement of this reduction gear to an up and down movement of the push-up plate 7. Alternatively, the driving mechanism 22 includes a cylinder or solenoid to move the push-up plate 7 up and down. The driving mechanism 22 is driven by a signal from the controller 17, and lowers the push-up plate 7 when the side cover 19 is opened, based on a detection signal from the microswitch 20 depending on if a jam occurred in the automatic document feeder and where the jam occurred. Details of this lowering process are explained below with respect to the flowcharts. In this embodiment, the driving mechanism 22 constitutes an automatic lowering unit and the controller 17 constitutes a control unit.

A push-up plate detecting sensor 23 is provided below the push-up plate 7 which detects that the push-up plate 7 has been lowered and outputs a signal to the controller 17 based on this detection. When the signal from the sensor 23 is inputted to the controller 17, the controller 17 stops the driving of the driving mechanism 22 because the push-up plate 7 is at a predetermined lowered position.

Figure 2A:
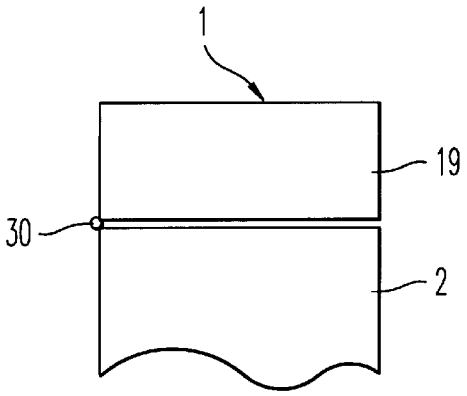
FIG. 2A shows a view from the side of the automatic feeding device 1 closed against the top of a copying machine 2.
Figure 2B:
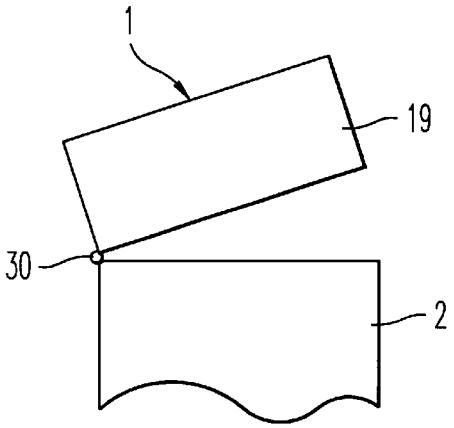
FIG. 2B shows a view from the side of the automatic feeding device in an open or raised position.

FIG. 2A is a side view of the automatic document feeding device 1 mounted on the copying machine 2. The automatic document feeding device is connected to the copier machine 2 by a hinge 30. The hinge 30 permits the automatic document feeder to be raised or opened, as illustrated in FIG. 2B.

FIG. 3 is a block diagram of the electrical components of the automatic document feeding device 1 and the copier machine 2. Each of these components has been previously described with respect to FIGS. 1A and 1B except for the user interface 32 and the input/output devices 34. The user interface 32 includes a keypad on the copier machine 2 used to input conventional information and commands such as a command to start a copying operation. The user interface 32 also includes a display to display information to the user including error messages pertaining to jams in the automatic document feeding device 1. The other input and output devices of the copier machine are designated by 34 which are conventional in nature.

Figure 4A:
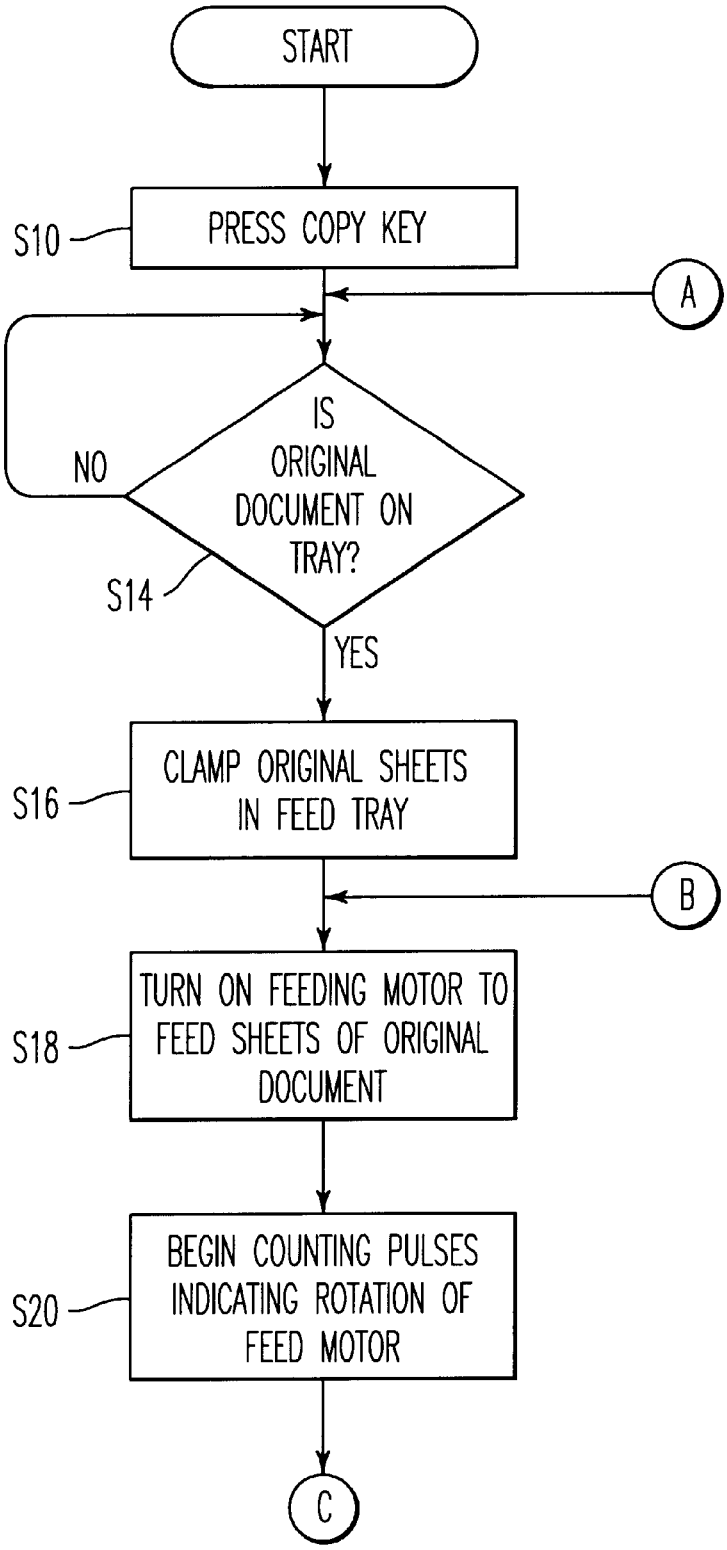
FIGS. 4A–4C are a flowchart showing the control of the device of the present invention.
Figure 4B:
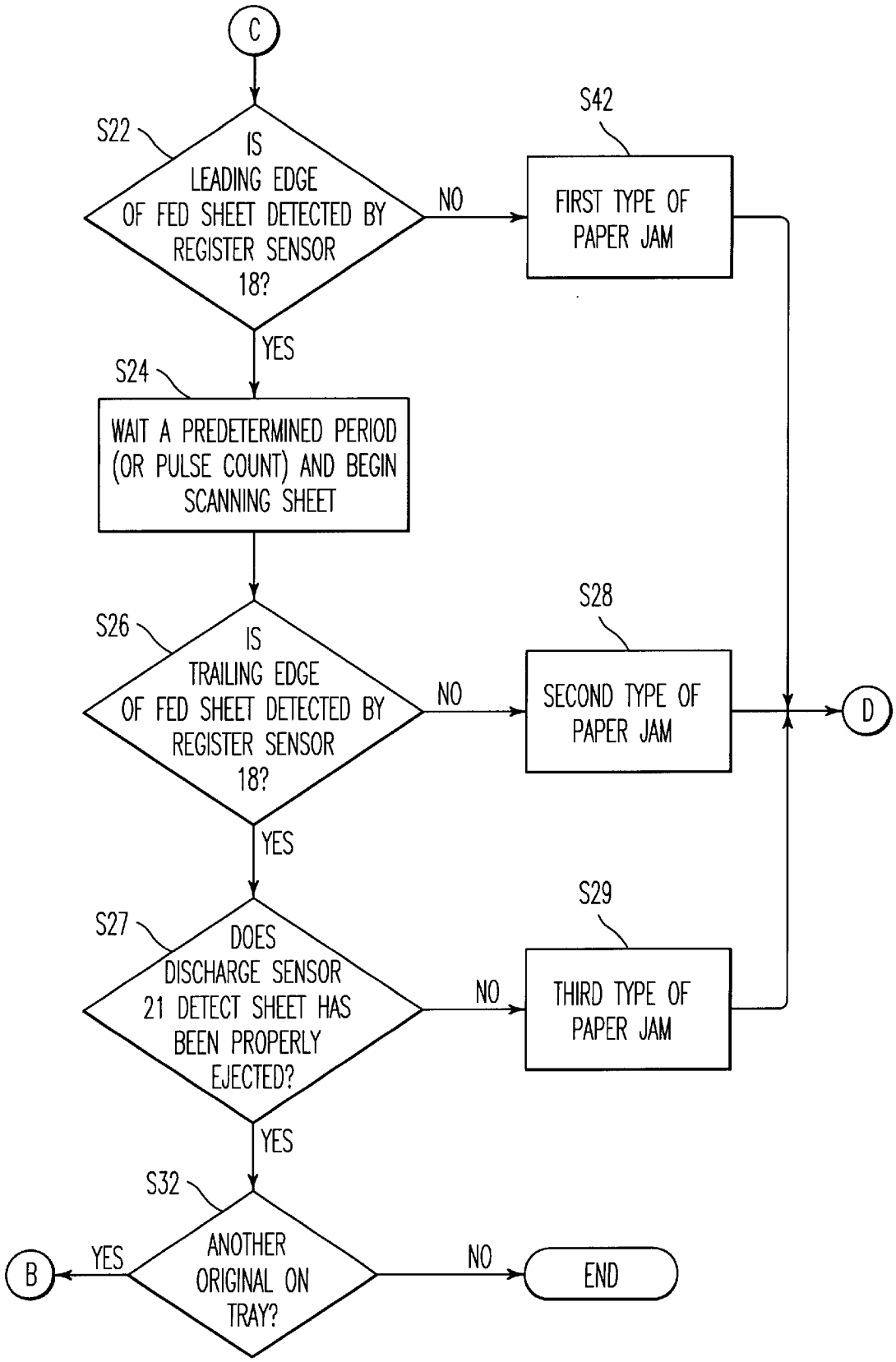
Figure 4C:
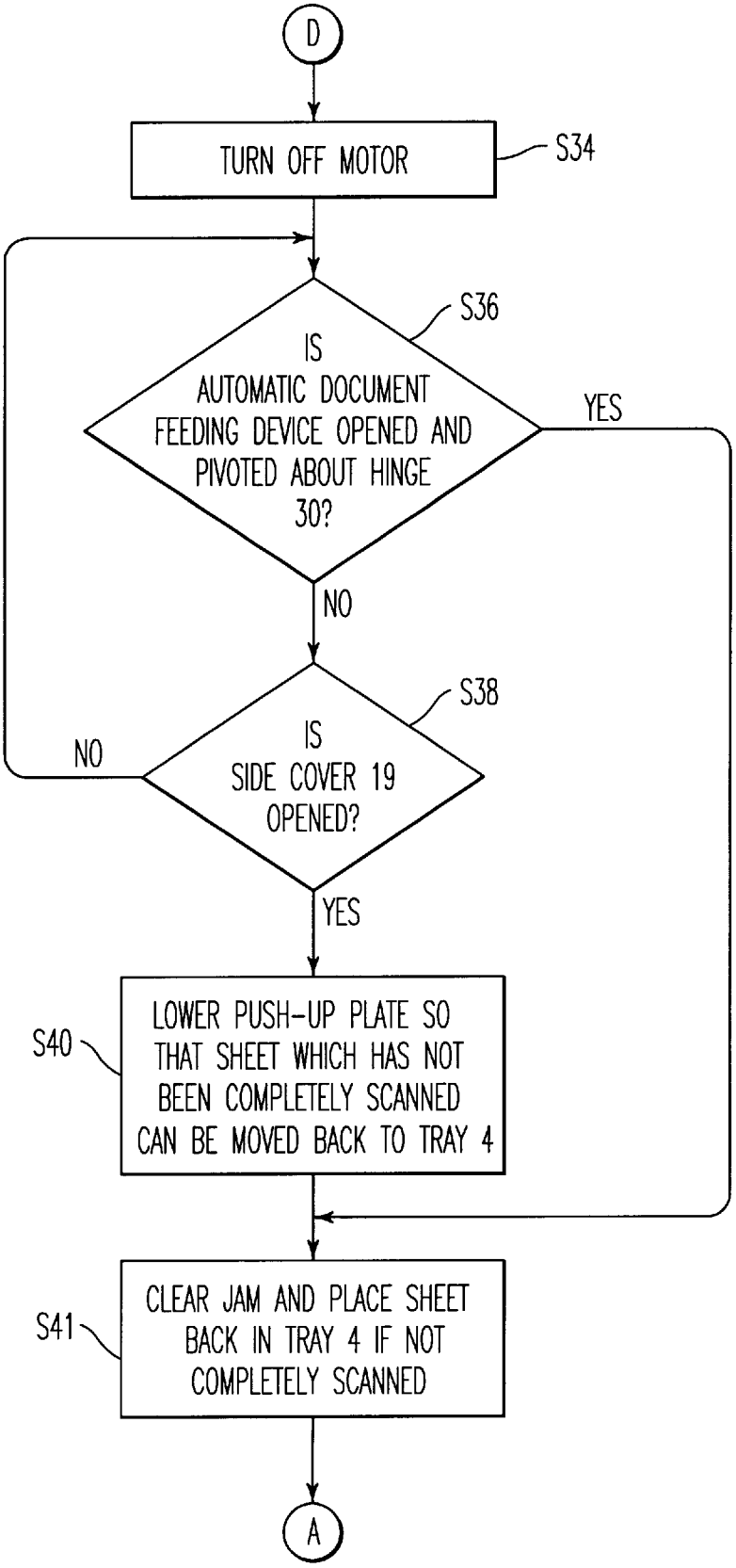

The operation of correcting paper jams in the automatic original document feeding device 1 is described with respect to FIGS. 4A–4C. In these flowcharts, when there is a paper jam and a sheet is detected within the feeding path 11 and the sheet has not been completely scanned, the user is prompted to open the side cover 11 in order to clear the jam. In this case, the push-up plate 7 is lowered when the side cover 19 is opened to enable the user to re-feed the sheet. However, if there are no sheets in the feeding path 11 when the jam occurs, the sheet was already scanned and there is no need to lower the push-up plate 7 because the document does not have to be re-fed by the automatic document feeding device.

A more detailed description of the overall operation of the device of the present invention will now be described with respect to FIGS. 4A–4C. After starting in FIG. 4A, a copy or scan button is pressed in step S10 and an operation of the document feeding device 1 begins. At step S14 it is then determined whether the original document P is on the tray 4. If it is determined that the original document is on the tray 4, i.e., YES in step S14, then the push-up plate 7 is pushed up in step S16 by turning on the driving mechanism 22 so that the push plate 7 is set to the predetermined feeding position to feed the sheets of the original document P. It is also possible that any other mechanism can be utilized to clamp or pressure the original sheets against the feed roller or belt.

The system then proceeds to step S18 where sheets of the original document P are fed by rotating the feeding belt 8 and operating the separating roller 9, and particularly by driving a motor which controls rotation of belt 8, which motor may be, as an example, a stepping motor. At step S20 a pulse counter also begins counting to detect a rotation of the motor which drives the belt 8, e.g., the stepping motor.

The system proceeds to step S22 where it is determined whether the leading edge of the fed sheet of the original document P is detected by the register sensor 18. If the register sensor 18 does not detect the leading edge of the original document P within a predetermined number of pulse counts, i.e., NO in step S22, it is then determined that a first type of paper jam has occurred in the conveying path 11 in step S42. In this situation, it is evident that the sheet of the original document P has not reached the register sensor 18 at the appropriate time, and thus a paper jam must have occurred during transfer of the sheet of the original document P prior to reaching the register sensor 18, i.e., in the feeding path 11.

The system then proceeds to step S34 in FIG. 4C which turns off the transfer motor controlling the belt 8. Step S36 then determines whether the document feeding device 1 has been raised, i.e. opened and pivoted about hinge 50, as illustrated in FIG. 2B. In this operation of the present invention, since the paper jam has occurred in the feeding path 11, an output on the display of the user interface will instruct an operator to open the side cover 19 to clear the paper jam and it is not necessary to open the document feeding device 1. As a result, in this operation, it will be determined that the document feeding device 1 has not been opened, i.e., NO at step S36, and the system then proceeds to step S38. Step S38 will then determine that the side cover 19 is opened as the display instructs the user to open the side cover 19. The push-up plate 7 is then lowered, by step S40 so that the sheet which has jammed and not properly scanned can be returned to the tray 4. As an alternative to lowering the push-up plate, any type of clamping mechanism utilized by the invention is unclamped in step S40. The user clears the jam in step S41 and in this situation (i.e., first type of jam), the user places the sheet back in tray 4. If it is determined that the cover 19 is not opened in step S38, the system then proceeds back to step S36.

If the leading edge of the sheet of the original document P is detected, i.e., YES at step S22, then the system proceeds to step S26 which determines if a trailing edge of the sheet of the original document P is detected. Also, a pulse counter is again started at this time. If step S26 determines that the register sensor 18 has not detected the trailing edge of the sheet of the original document P, i.e., NO in step S26, the system proceeds to step S28 where it is noted that a second type of paper jamming has occurred. This second type of paper jamming is a paper jam in which the leading edge of the sheet of the original document P has passed the scanning slit 5, but the trailing edge of the sheet of the original document P has not passed scanning slit 5, i.e., this sheet has not been fully scanned by the slit 5. The system then proceeds from step S28 to step S34 where the transfer motor is again turned off so that the feeding belt 8 and separating roller 9 are no longer activated. The system then proceeds to step S36. In this operation, since the paper jam has occurred still at least partially in the feeding path 11, an output on a display will instruct an operator to open the cover 19 to clear the paper jam. As a result, in this operation it will again be determined that the document feeding device has not been opened, i.e., a NO will result at step S36, and the system will proceed to step S38.

In step S38, the side cover will be opened by the user in order to gain access to the jam because of instruction to the user by the display. Then, the driving mechanism 22 is actuated to automatically lower the push-up plate 7 in step S40 so that the sheets of the original document P which have been piled and housed on the push-up plate 7, i.e., those sheets which still must be copied, are lowered out of their feeding position. This allows the operator to clear the jam in step S41 and replace the sheet that was jammed back in the tray 4 along with the unscanned sheets.

If step S26 determines that the register sensor 18 has detected the trailing edge of the sheet of the original document P, the system then proceeds to step S27. At step S27, it is determined whether the discharge sensor 21 has detected the leading and trailing edges of the fed sheet, which can also be based on the output of a counter. If the discharge sensor 21 does not detect the leading edge of the fed paper sheet within a predetermined period of time, or detect the leading edge but does not then detect the trailing edge of the fed sheet within a predetermined period of time, then it is determined that a third type of jamming has occurred in step S29. This third type of jamming is a jam which occurs after the sheet of the original document P has been fully scanned and copied, but jamming occurs in the eject path 14. In this situation, the system of the present invention then proceeds to step S34 where the transfer motor is then turned off. In this situation, because the paper jam has occurred in the eject path 14, an operator will be prompted to open the document feeding device 1 to remove the jammed sheet from the discharge path 14. That is, in this operation of the present invention, the user will open the automatic document feeding device and step S36 will determine that the device has been opened. The system of the present invention will then proceed to step S41 where the jam is cleared, back to step S14 and the process of the invention continues. Then, the system proceeds to step S32 where it is determined whether another sheet of the original document P is on the tray P. If YES in step S32, the system proceeds to step S18 so that a next sheet of the original document P is fed and processed. If NO in step S32, this ends the operation of the document feeder of the present invention.

With the third type of jam in which the jam occurs after scanning is complete and occurs in the eject path 14, the side cover 19 is not opened and the push-up plate 7 remains at the prescribed feeding position without being lowered and no time is taken to perform step S16 because the push-up plate is already raised as step S40 is not performed. Therefore a feeding of sheets of the original document P can be resumed instantly after the jamming is corrected, and thus a length of time required for re-feeding can be shortened. To the contrary, when the first or second type of jam occurs, it is necessary to lower the push-up plate 7 in order to reinsert the jammed page so that it could be scanned.

Figure 5:
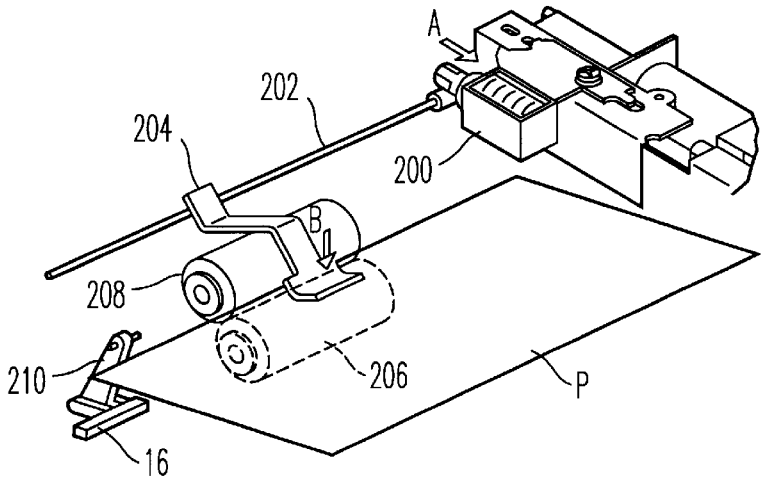
FIG. 5 illustrates an alternative embodiment of a device used to clamp a document and feed the document out of a paper tray.

FIG. 5 illustrates an alternative embodiment of the invention in which the sheets of paper of a document P are clamped or in pressured contact against a feed roller utilizing a different mechanism than the push-up plate 7 illustrated in FIGS. 1A and 1B. In FIG. 5, a feeding lever 204 clamps the sheets of a document P which are in the original feeding tray against a feeding roller 206 which is illustrated using broken lines to indicate that it is covered by the document P. As an alternative to the roller 206, a feeding belt may be utilized. The feeding lever 204 is controlled by a solenoid 200 connected thereto utilizing a rod or connector 202. When the solenoid moves inwardly in the direction marked with an arrow A, the rod 202 moves in a similar direction which causes the feeding lever 204 to press downwardly on the document P in the direction of the arrow marked with B.

When the document P is placed in the tray of the device of FIG. 5, a lever 210 is pivoted away from the sensor 16, thus detecting the presence of the document P. In order to feed sheets of the document P, the rollers 206 and 208 are driven by a motor to rotate and feed single sheets from the document P. In this embodiment, the sheets of the document P will be taken from the bottom of the stack of sheets.

Figure 6:
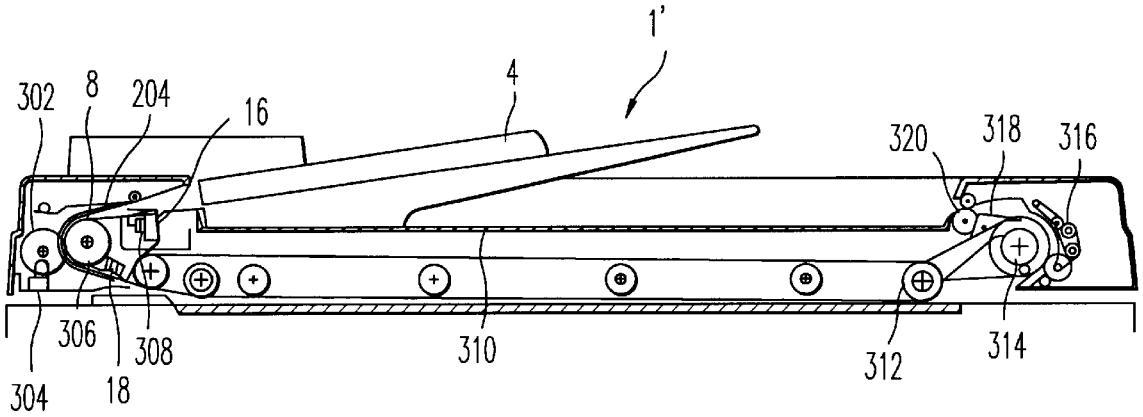
FIG. 6 illustrates an alternative type of automatic document feeder which can be utilized by the present invention.

FIG. 6 illustrates an alternative type of automatic document feeding device 1' which is used to feed original documents. This automatic document feeding device 1' is sometimes referred to as a book-type document feeder. In accordance with the general principles of the present invention, the automatic document feeding device 1' illustrated in FIG. 6 will have a device which clamps or presses the document against a feeding roller or belt. In FIG. 6, there is a feeding lever 204 which can be utilized to press the document against a feeding belt 8 which wraps around a feeding roller 306. Alternatively, it is possible to incorporate a push-up plate into this embodiment in a similar manner as the push-up plate is used in FIGS. 1A and 1B.

FIG. 6 also includes a roller 302 for guiding the paper and includes a pulse counter 304. There is a transfer belt 310 which is guided by end rollers 308 and 212. Further, a reversing roller 314 is utilized to reverse a sheet in order to eject the sheet out of the automatic document feeder utilizing ejecting roller 320. Alternatively, a switching gate 318 may be utilized to reverse the orientation of sheets in order to copy or scan a reverse side of the sheets. The automatic document feeder further includes an ejection sensor 316 for sensing that a sheet is passing the reversing roller 314.

This invention may be conveniently implemented using a conventional general purpose digital computer or microprocessor programmed according to the teachings of the present specification, as will be apparent to those skilled in the computer art. Appropriate software coding can readily be prepared by skilled programmers based on the teachings of the present disclosure, as will be apparent to those skilled in the software art. The invention may also be implemented by the preparation of application specific integrated circuits or by interconnecting an appropriate network of conventional component circuits, as will be readily apparent to those skilled in the art.

It is to be noted that the various sensors utilized by the invention to detect the location of sheets and jams output electrical signals to the controller and can be implemented using conventional optical sensors, mechanical-optical sensors such as the combination of 210 and 16 in FIG. 5, mechanical sensors, or any type of sensors utilized to detect the existence of papers or the sensing of paper jams.

Obviously, numerous additional modifications and variations of the present invention are possible in light of the above teachings. It is therefore to be understood that within the scope of the appended claims, the present invention may be practiced otherwise than as specifically described herein.

What is claimed as new and is desired to be secured by Letters Patent of the United States is:

1. A device which feeds sheets of a document, comprising:

a tray for holding a plurality of sheets of an original document;

a feeding device which feeds sheets out of the tray;

a pressing device which presses the sheets of the original document against the feeding device;

a feed path through which the sheets are fed from the tray to a scanning position, including a pair of conveying rollers;

a feed path sensor which detects a jam in the feed path;

a cover which covers access to the feed path at a position downstream, relative to a direction of travel of the sheets, of the pressing device and the feeding device, the cover separating one of the pair of conveying rollers from another of the pair of conveying rollers when the cover is opened;

a cover sensor which detects whether the cover is opened or closed;

an eject path though which the sheets are ejected out of the feeding device after passing the scanning position; and a control means, connected to the feeding device, the pressing device, the feed path sensor, and the cover sensor, which causes the pressing device to stop pressing the sheets of the document against the feeding device when the feed path sensor detects a jam in the feed path and the cover sensor detects that the cover is open.

2. A device according to claim 1, further comprising:

an eject path sensor, connected to the control means, which detects a jam in the eject path, wherein the control means includes means for maintaining the pressing device to press the sheets of the document against the feeding device when the eject path sensor detects a jam in the eject path.

3. A device according to claim 2, wherein:

the control means includes means for maintaining the pressing device to press the sheets of the document against the feeding device when the eject path sensor detects a jam in the eject path and the feed sensor does not detect a sheet in the feed path.

4. A device according to claim 3, further comprising:

an image processing device which scans the sheets at the scan position;

a hinge connecting the image processing device to the feeding device which allows the feeding device to pivot in order to raise the feeding device; and a display, wherein the control means instructs the display to display a message to the user to clear a jam by opening the cover when the jam occurs in the feed path, and the control means instructs the display to display a message to the user to clear a jam by raising the feeding device, relative to the image processing device, when the jam occurs in the eject path.

5. A device according to claim 1, wherein:

the pressing device includes a device to raise the document and push the document against the feeding device.

6. A device according to claim 5, wherein the feeding device includes a feeding belt.

7. A device according to claim 5, wherein the feeding device includes a feeding roller.

8. A device according to claim 1, wherein:

the pressing device includes a feeding lever to press the document down against the feeding device.

9. A device according to claim 8, wherein the feeding device includes a feeding belt.

10. A device according to claim 8, wherein the feeding device includes a feeding roller.

11. A method for feeding a plurality of sheets of an original document, comprising the steps of:

placing the sheets of the original document in pressured contact with a feeding device;

feeding the sheets of the original document to an image reading position through a feeding path;

detecting if any of the sheets of the original document jam in the feeding path;

opening a cover of the feeding path, the cover covering a position downstream, relative to a direction of travel of the sheets, of the feeding device, and covering a pair of conveying rollers;

separating one of the pair of the conveying rollers from another of the pair of conveying rollers by the opening of the cover;

detecting if the cover of the feeding path is opened; and removing the pressured contact between the sheets of the original document and the feeding device when any of the sheets of the original document are detected to be jammed in the feeding path and the cover is detected to be open.

12. A method according to claim 11, further comprising the steps of:

detecting if any of the sheets of the original document jam after the feeding path; and maintaining the sheets of the original document in pressured contact against the feeding device if any of the sheets of the original document are detected as jamming after the feeding path.

13. A method according to claim 12, wherein:

the step of maintaining the sheets of the original document in pressured contact against the feeding device is performed when any of the sheets of the original document are detected as jamming past the feeding path and the step of detecting if any of the sheets of the original document jam in the feeding path does not detect that sheets of the original document are jammed in the feeding path.

14. A method according to claim 13, further comprising the steps of:

displaying a message to a user to clear a jam by opening the cover when the jam occurs in the feeding path; and displaying a message to the user to clear a jam by raising the feeding device, relative to an image processing device upon which the feeding device is mounted, when the jam occurs in the eject path.

15. A method according to claim 11, wherein:

the step of placing the sheets of the original document in pressured contact with the feeding device raises the document against the feeding device.

16. A method according to claim 11, wherein:

the step of placing the sheets of the original document in pressured contact with the feeding device raises the document against the feeding device which includes a feeding belt.

17. A method according to claim 11, wherein:

the step of placing the sheets of the original document in pressured contact with the feeding device raises the document against the feeding device which includes a feeding roller.

18. A method according to claim 11, wherein:

the step of placing the sheets of the original document in pressured contact with the feeding device includes pressing the document downwardly against the feeding device.

19. A method according to claim 18, wherein:

the step of placing the sheets of the original document in pressured contact with the feeding device includes pressing the document against the feeding device which includes a feeding belt.

20. A method according to claim 18, wherein:

the step of placing the sheets of the original document in pressured contact with the feeding device includes pressing the document against the feeding device which includes a feeding roller.

* * * * *